United States Patent [19]

Forry et al.

[11] 3,999,675

[45] Dec. 28, 1976

[54] CARRIAGE ASSEMBLY OF A VEHICLE

[75] Inventors: James E. Forry, Monmouth; Cyril J. Nisbett, Salem, both of Oreg.

[73] Assignee: Towmotor Corporation, Mentor, Ohio

[22] Filed: Nov. 28, 1975

[21] Appl. No.: 636,248

[52] U.S. Cl. ..... 214/730; 187/95; 308/3 R

[51] Int. Cl.[2] ..... B66F 9/14

[58] Field of Search ..... 214/660, 730, 731, 750; 308/3; 187/9, 95

[56] References Cited

UNITED STATES PATENTS

| | | | |
|---|---|---|---|
| 2,719,761 | 10/1955 | Bonnafe | 308/3 A |
| 2,758,890 | 8/1956 | Boylan | 187/95 |
| 2,931,684 | 4/1960 | Johnson | 308/3 A |
| 3,044,576 | 7/1962 | Quayle | 187/95 |
| 3,512,671 | 5/1970 | Morocco | 214/730 |

*Primary Examiner*—Robert J. Spar
*Assistant Examiner*—Lawrence J. Oresky
*Attorney, Agent, or Firm*—Frank L. Hart

[57] ABSTRACT

An improved carriage of a vehicle has slide blocks of organic plastic for maintaining the carriage correctly positioned relative to the frame and for movably connecting first and second frames of the carriage together for translatory movement of the second frame.

6 Claims, 8 Drawing Figures

CARRIAGE ASSEMBLY OF A VEHICLE

BACKGROUND OF THE INVENTION

In the construction of vehicles, as for example a lift truck as shown in U.S. Pat. No. 3,851,732 which issued Dec. 3, 1974 to R. A. Wagner et al. from an application filed Feb. 8, 1973, rollers were used to stabilize the carriage assembly and prevent canting of the carriage assembly relative to the mast assembly and thereby eliminate undesirable forces on the longitudinal roller. Later, translating lifting forks were provided which used rollers for providing the translatory movement of the frame and the lifting fork along another frame of the carriage assembly.

These roller assemblies function satisfactorily. However, they are constructed of a multiplicity of parts, are relatively difficult to assemble and are subjected to greater wear than desirable owing to dirt and grit attracting properties of lubricants that are applied to them. Further, the contacting area of support of the rollers is less than desirable for lift trucks that are designed to transport extra heavy loads and subject the bearing surface to high stresses.

This invention therefore resides in unique slide blocks positioned between selected moving parts of the carriage assembly. The slide blocks and connecting structure are of a construction for maintaining the carriage assembly against canting, providing a greater contacting support area, and are formed of a material which eliminates the need for lubricants.

DETAILED DESCRIPTION OF THE INVENTION

Figure 1:
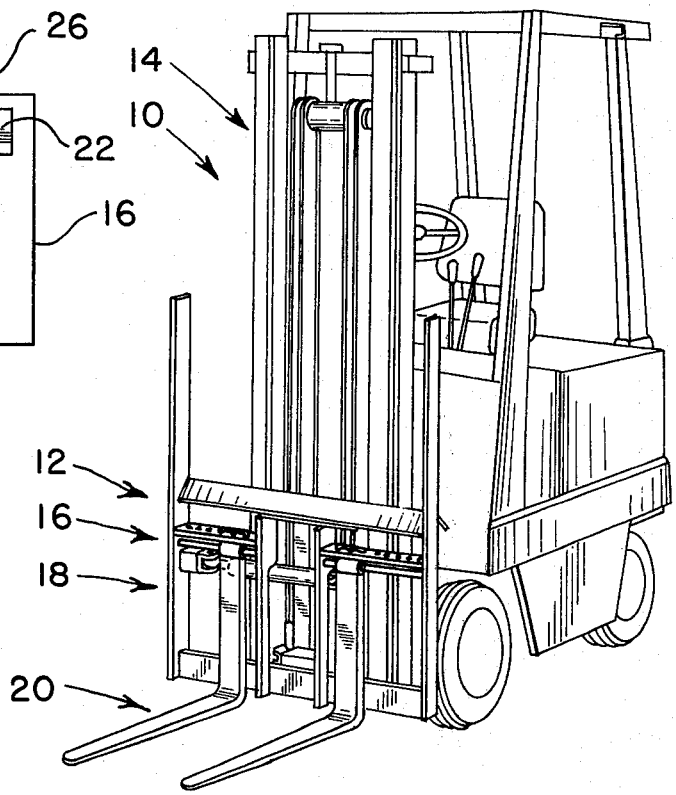
FIG. 1 is a perspective view of an example lift truck.

Referring to FIG. 1, a vehicle such as a lift truck 10 has a carriage assembly 12 movably mounted on a mast assembly 14. The carriage assembly 12 has first and second frames 16,18 (see FIGS. 3 and 4) movably connected one to the other and a lift means, for example forks 20, connected to the second frame 18. As is known in the art, the second frame 18 is movably connected to the first frame 16 for lateral translation of the forks 20 across the mast assembly 14. The frames 16,18 are mounted on the mast assembly 14 and generally vertically movable therealong for positioning the forks 20 at selected elevations.

Figure 2:
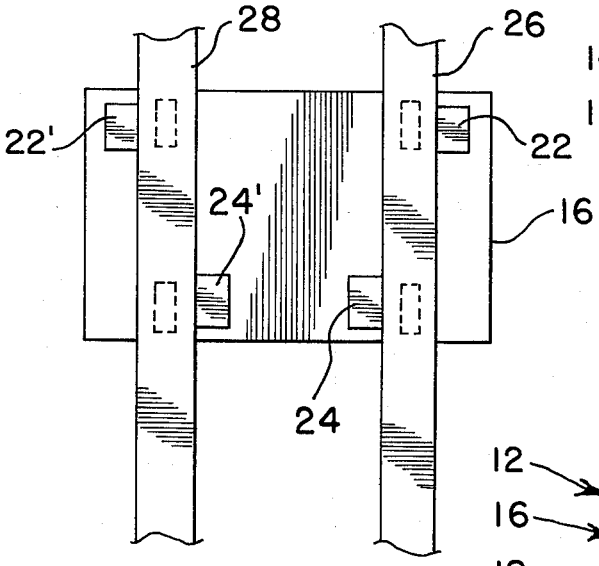
FIG. 2 is a diagrammatic back view of portions of the carriage assembly and mast assembly.

Referring to FIG. 2, at least one pair of primary slider blocks 22,24 are connected to the first frame 16 at locations sufficient for contacting an upright mast element 26 and maintaining the first frame 16 and associated second frame 18 and forks 20 against lateral movement relative to the mast assembly 14. Where there are two or more mast elements 26,28 forming the mast assembly 14, at least a pair of primary slider blocks 22,24 and 22',24' should be associated with each mast element 26,28.

Figure 3:
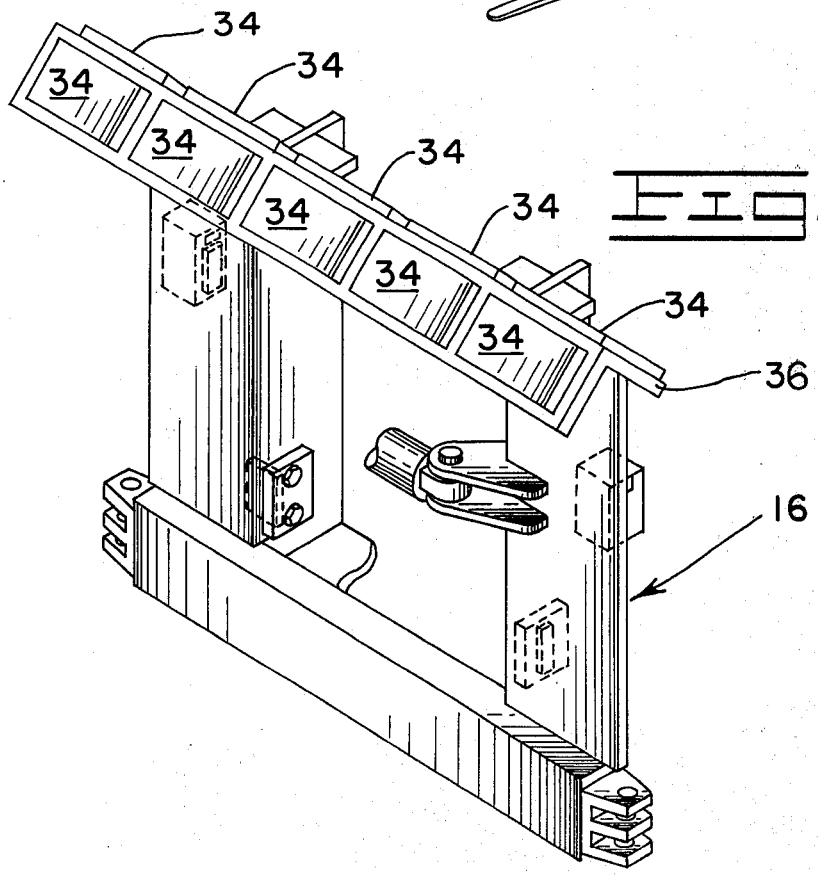
FIG. 3 is a diagrammatic perspective view of a portion of the first frame member of the carriage assembly.

Referring to FIG. 3, a plurality of secondary slider blocks 34 are connected to one of the first or second frames 16,18 at a location between said frames 16,18 in the installed position wherein the second frame 18 is movably supported by the first frame 16 for translatory movement of the second frame 18 and associated forks 20, as set forth above.

Figure 4:
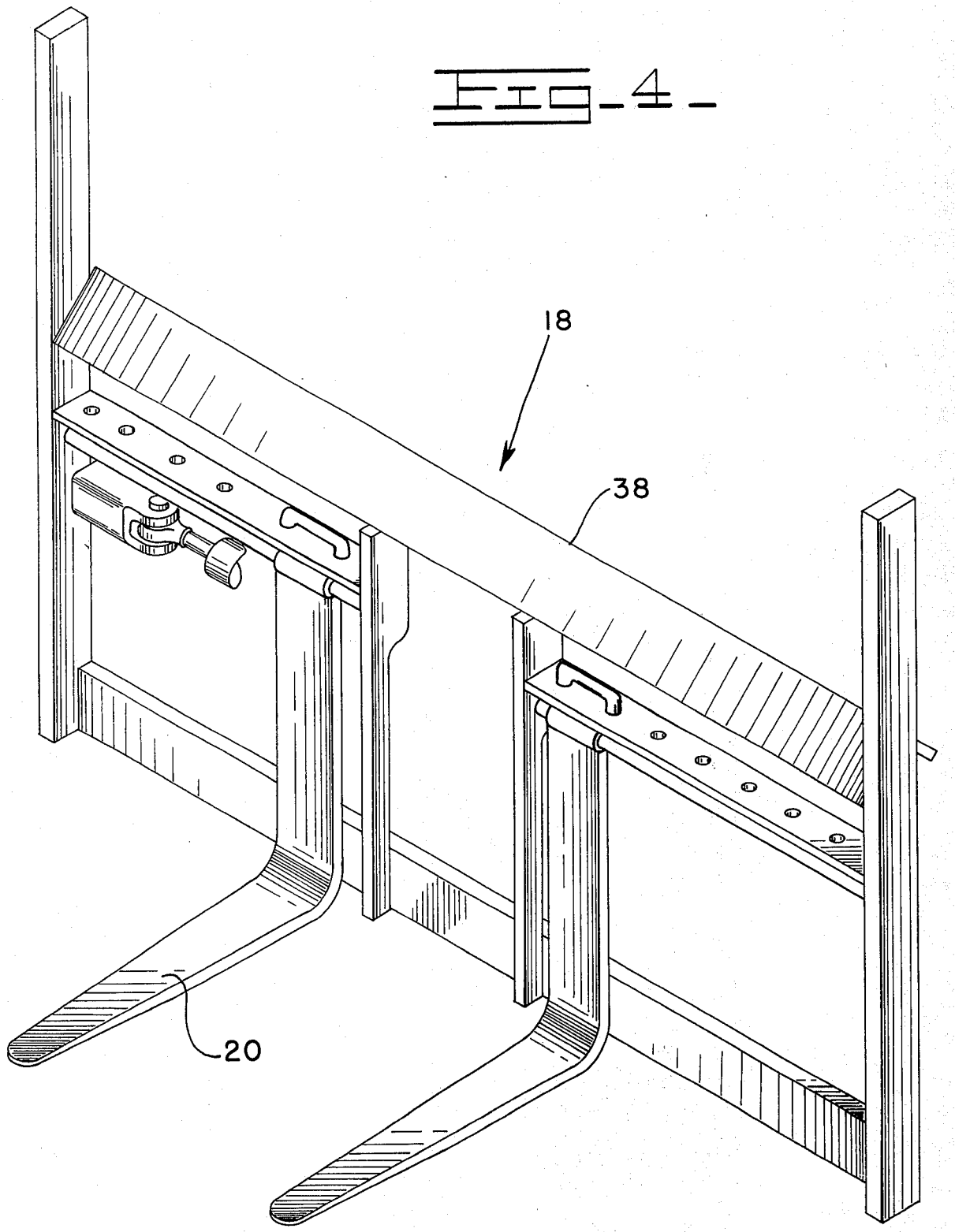
FIG. 4 is a diagrammatic perspective view of a portion of the second frame member of the carriage assembly.

In the preferred embodiments shown in FIGS. 3 and 4, the first and second frames 16,18 each have a respective elongated connecting element 36,38 extending across an upper portion thereof. The connecting elements 36,38 are preferably oriented generally horizontally and are of an inverted "V" configuration.

Figure 5:
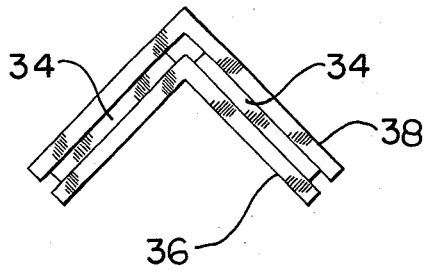
FIG. 5 is a diagrammatic end view of connecting elements of the first and second frame members.

Referring to FIG. 5, in the installed position, the first connecting element 36 is nesting in the overlying second connecting element 38 and the plurality of secondary slider blocks 34 are positioned between contacting opposed legs of each of said elements 36,38.

The slider blocks 22, 24, 34 are formed of organic plastic material for providing a material to which dust and dirt will generally not adhere and which does not require lubrication. The particular organic plastic utilized depends upon the forces that are expected to be subjected onto the blocks. One skilled in the art can readily select the material after these forces have been determined. Example materials are high molecular weight polyethylene, polyamides, and other polyolifins. The organic plastic can also have filler materials and strengthening material as suggested by the loads that will be subjected onto the blocks.

An example block is formed of 1900 UHMW polymer blended with 15% fiberglass strands. 1900 UHMW polymer is a trade name of ultrahigh molecular weight high-density polyethylene which is manufactured by Hercules Incorporated of Wilmington, Delaware.

The example block has proven to be resistant to impact loading, wear resistant, resistant to chemicals and abrasives, self lubricating, and has high energy absorption properties with excellent size stability. The fiberglass strands maintain against heat deflection and cold flow and provide stiffness for the resultant blocks. The addition of the fiberglass strands to the organic plastic causes no detectable abrasion resistance loss and only insignificant losses of impact resistance of the polymer.

Figure 6:
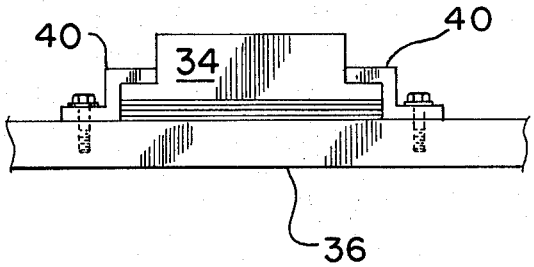
FIG. 6 is a diagrammatic view of a slide block connected to one of the connecting elements.
Figure 7:
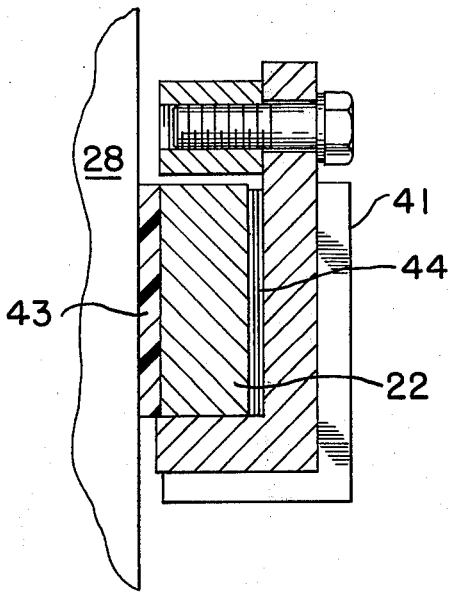
FIG. 7 is a diagrammatic view of a connecting channel of the primary slide blocks.
Figure 8:
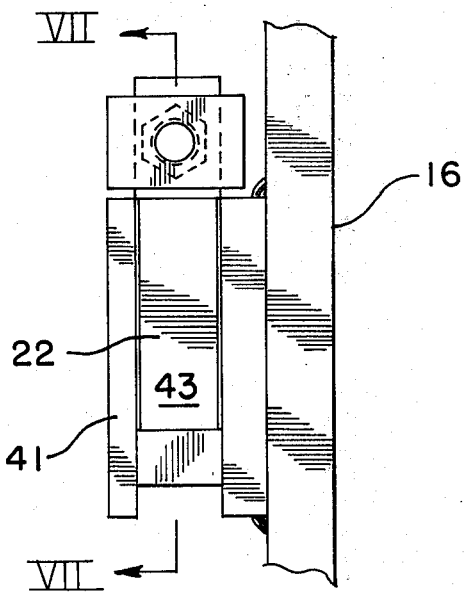
FIG. 8 is a diagrammatic sectional view of FIG. 7.

The slider blocks 22,24,34 can be connected to their respective elements by any means desirable. In the preferred embodiments shown in FIGS. 6, 7, and 8, the secondary slider blocks 34 are connected by a flange element 40 extending over a ledge formed along the edge of the tertiary slider blocks 34. The flange element 40 can be connected, for example, to the connecting element 36 by welding or bolts. Referring to FIGS. 7 and 8, the primary slider blocks 22,23 can be positioned in a channel member 41 which are in turn connected to the first frame 16 by bolts or welding for example. The associated adjacent mast element 26,28 contacts the outer face 43 of said slider blocks as described above. As shown, the channel member 41 encompasses the slider block 22 and prevents movement of the block 22 along the first frame 16.

Shims 44 or other adjustable means, such as a threaded member connected to a backing plate, can be associated with the primary, secondary, and tertiary elements for adjusting the contacting force between slider blocks 22,24 and the mast assembly 14 and the distance the secondary slider blocks 34 extends outwardly from the first frame 16. For example, note that in FIG. 6 the close spaced, horizontal, parallel lines represent a shim similar to shim 44 in FIG. 7.

Other aspects, objects, and advantages of this invention can be obtained from a study of the disclosure and appended claims.

What is claimed is:

1. In a vehicle having a carriage assembly mounted on a mast assembly, said carriage assembly having first and second frames connected one to the other and a lift means connected to the first frame, said second frame being movably connected to the first frame for laterally translating the lift means across the mast and said first frame being connected to the mast and generally vertically movable therealong for positioning the lift means at selected elevations, the improvement comprising:

at least a pair of primary slider blocks mounted on the first frame at locations sufficient for contacting the mast and maintaining the first frame against lateral movement relative to the mast, said slider blocks being of organic plastic material;

a plurality of secondary slider blocks each having an outwardly extending ledge and being connected to one of the first or second frames at a location between said frames for movably supporting the second frame, said slider blocks being of organic plastic material, said first and second frames each have an elongated connecting element extending across an upper portion thereof, said connecting elements each being of an inverted "V" cross-sectional configuration, said second frame connecting element overlying said first frame connecting element, and said plurality of slider blocks being positioned between said connecting elements; and a flange element connected to the secondary frame and extending over the ledge of the secondary slider blocks for connecting the secondary slider blocks to one of the connecting elements.

2. Apparatus, as set forth in claim 1, wherein the mast comprises first and second spaced upright elements and including a pair of primary slider blocks mounted on the first frame on opposed sides of each first and second upright mast element.

3. Apparatus, as set forth in claim 1, including a plurality of channel elements connected to the first frame, each of said channel elements having a primary slider block positioned therein for mounting the slider blocks on the first frame.

4. Apparatus, as set forth in claim 1, including means for adjusting the distance the secondary slider blocks extend outwardly from a respective connecting element.

5. Apparatus, as set forth in claim 1, wherein the slider blocks are polyethylene.

6. Apparatus, as set forth in claim 1, including means for adjusting the contacting force between the primary slider blocks and the mast.

* * * * *